US005457839A

United States Patent [19]

Csagoly

[11] Patent Number: 5,457,839

[45] Date of Patent: Oct. 17, 1995

[54] BRIDGE DECK SYSTEM

[76] Inventor: Paul F. Csagoly, 1852 Lake Cypress Dr., Safety Harbor, Fla. 34695

[21] Appl. No.: 156,624

[22] Filed: Nov. 24, 1993

[51] Int. Cl.[6] ..... E01D 19/12

[52] U.S. Cl. ..... 14/73; 52/223.7

[58] Field of Search ..... 14/73, 73.1, 77.1; 52/223.1, 223.6, 223.7, 333, 334; 264/228; 404/47

[56] References Cited

U.S. PATENT DOCUMENTS

| | | | |
|---|---|---|---|
| 1,235,636 | 8/1917 | Bagnall et al. . | |
| 2,114,773 | 4/1938 | Auten et al. | 14/73 |
| 3,110,049 | 11/1963 | Nagin . | |
| 3,253,289 | 5/1966 | Nagin | 14/73 |
| 3,260,023 | 7/1966 | Nagin | 404/47 X |
| 3,967,426 | 7/1976 | Ault et al. . | |
| 4,151,694 | 5/1979 | Sriberg et al. . | |
| 4,309,125 | 1/1982 | Richardson . | |
| 4,604,841 | 8/1986 | Barnoff et al. . | |
| 4,627,203 | 12/1986 | Presswalla et al. | 52/223.6 X |
| 4,693,046 | 9/1987 | Murayama . | |
| 4,700,519 | 10/1987 | Person et al. . | |
| 4,709,435 | 12/1987 | Stemler et al. . | |
| 4,785,600 | 11/1988 | Ting . | |
| 4,809,474 | 3/1989 | Ekberg, Jr. . | |
| 4,831,675 | 5/1989 | Nedelcu . | |
| 4,972,537 | 11/1990 | Slaw, Sr. | 14/73 X |
| 4,991,248 | 2/1991 | Allen | 14/73 |
| 5,025,522 | 6/1991 | Eskew et al. . | |
| 5,033,147 | 7/1991 | Svensson . | |
| 5,220,761 | 6/1993 | Selby . | |

FOREIGN PATENT DOCUMENTS

| | | | |
|---|---|---|---|
| 2622907 | 5/1989 | France | 14/73 |
| 2053308A | 2/1981 | United Kingdom . | |

OTHER PUBLICATIONS

Paul F. Csagoly and William N. Nickas, "Florida Bulb–Tee and Double–Tee Beams", *Concrete International*, pp. 18–23, Nov. 1987.

Advertisement, Southern Prestressed Inc., "New Double Tee Bridge System", publication date unknown.

*Primary Examiner*—Ramon S. Britts
*Assistant Examiner*—James A. Lisehora
*Attorney, Agent, or Firm*—Banner & Allegretti, Ltd.

[57] ABSTRACT

A reduced-weight bridge deck having a plurality of areas which are void of concrete to provide a lower dead load force and to reduce the product costs. The bridge deck includes structural support bars, post-tensioning ducts and a concrete component. Concrete component has spaced downwardly projecting protrusions which laterally distribute forces and permit the ability of providing areas void of concrete therebetween. The post-tensioning ducts are located within and extend through the downwardly projecting protrusions. The strength of deck is achieved by placing the tendons within the ducts. The tendons are tightened and anchored to the ends of the deck to prestress the concrete component. The unique section design and the post-tensioning eliminates the need for reinforcing bars which can deteriorate and contribute to structural failures. Methods for manufacturing the bridge deck from precast panels and by cast-in-place sections are also disclosed.

9 Claims, 4 Drawing Sheets

BRIDGE DECK SYSTEM

FIELD OF THE INVENTION

This invention relates to a concrete and steel deck system used for bridge super-structures supported by beams. More specifically, this invention relates to a bridge deck system which utilizes the concept of post-tensioning in combination with a unique deck section design to achieve a significant weight reduction in the bridge deck and which provides adequate load carrying capacity.

BACKGROUND OF THE INVENTION

The concrete slab reinforced by steel bars has been the most commonly used type of bridge deck construction for highways. However, many of these highway bridge decks have failed, because of the corrosion of the steel bars and the disintegration of the concrete. Concrete decks are susceptible to transverse cracking and delamination.

Concrete and steel structural combination bridge decks have been used for many years in an attempt to overcome the disadvantage of the low tensile strength of concrete and improve performance. Many of these concrete-steel composite bridge decks include a steel grid which is filled and/or covered with concrete. Typically, these decks use a large quantity of concrete which increases the material cost and weight of the deck. In addition, many of these bridge decks require reinforcing bars or expanded metal to strengthen the concrete. While these reinforcing members may help strengthen the concrete, they are also susceptible to corrosion which contributes to structural failures.

It would be desirable to have a reduced-weight bridge deck which would have excellent strength characteristics, a reduced tendency for cracking, and which would be inexpensive to manufacture and assemble. In addition, it would be desirable to have a bridge deck which does not require reinforcing bars. Further, it would be advantageous if the bridge deck design was adaptable so that it could either be cast-in-place or made of precast panels.

SUMMARY OF THE INVENTION

It is an object of this invention to provide a concrete-steel deck system which includes a number of adjacent sections or panels post-tensioned together to provide a reduced-weight bridge deck of adequate strength.

It is another object of this invention to provide a concrete-steel deck system which includes panels or sections having spaced parallel structural steel bars which are longitudinal to the panels or sections and does not require a grid with structural steel bars extending in both the transverse and longitudinal directions.

It is yet another object of this invention to provide a concrete-steel deck system which does not require reinforcing bars or expanded metal to strengthen the concrete.

Further, it is an object of this invention to provide a bridge deck including a concrete component having downwardly projecting protrusions. Structural support bars extending only longitudinally to bridge deck sections are partially embedded in the concrete component. Post-tensioning ducts are oriented perpendicular to the structural support bars, i.e., lateral to the bridge deck sections, and extend through the concrete component. The post-tensioning ducts extend parallel to the downwardly projecting protrusions. Post-tensioning tendons are located in the post-tensioning ducts.

It is another object of this invention to provide a method of manufacturing a bridge deck to be supported on beams. The method of manufacturing includes precasting or casting-in-place deck panels or sections. The method includes depositing concrete around structural support bars and post-tensioning ducts such that the structural support bars and the post-tensioning ducts are embedded in the concrete and that a lower portion of the deck panel or section includes downwardly extending concrete formations and void sections free of concrete located between the formations. The post-tensioning ducts of adjacent deck panels are aligned and structurally coupled to form continuous coaxial ducts. Tendon members are positioned within the aligned ducts. The deck is post-tensioned after the concrete is permitted to substantially cure.

These and other objects and features of the invention will be apparent upon consideration of the following detailed description of preferred embodiments thereof, presented in connection with the following drawings in which like reference numerals identify like elements throughout.

DESCRIPTION OF THE PREFERRED EMBODIMENT

Figure 1:
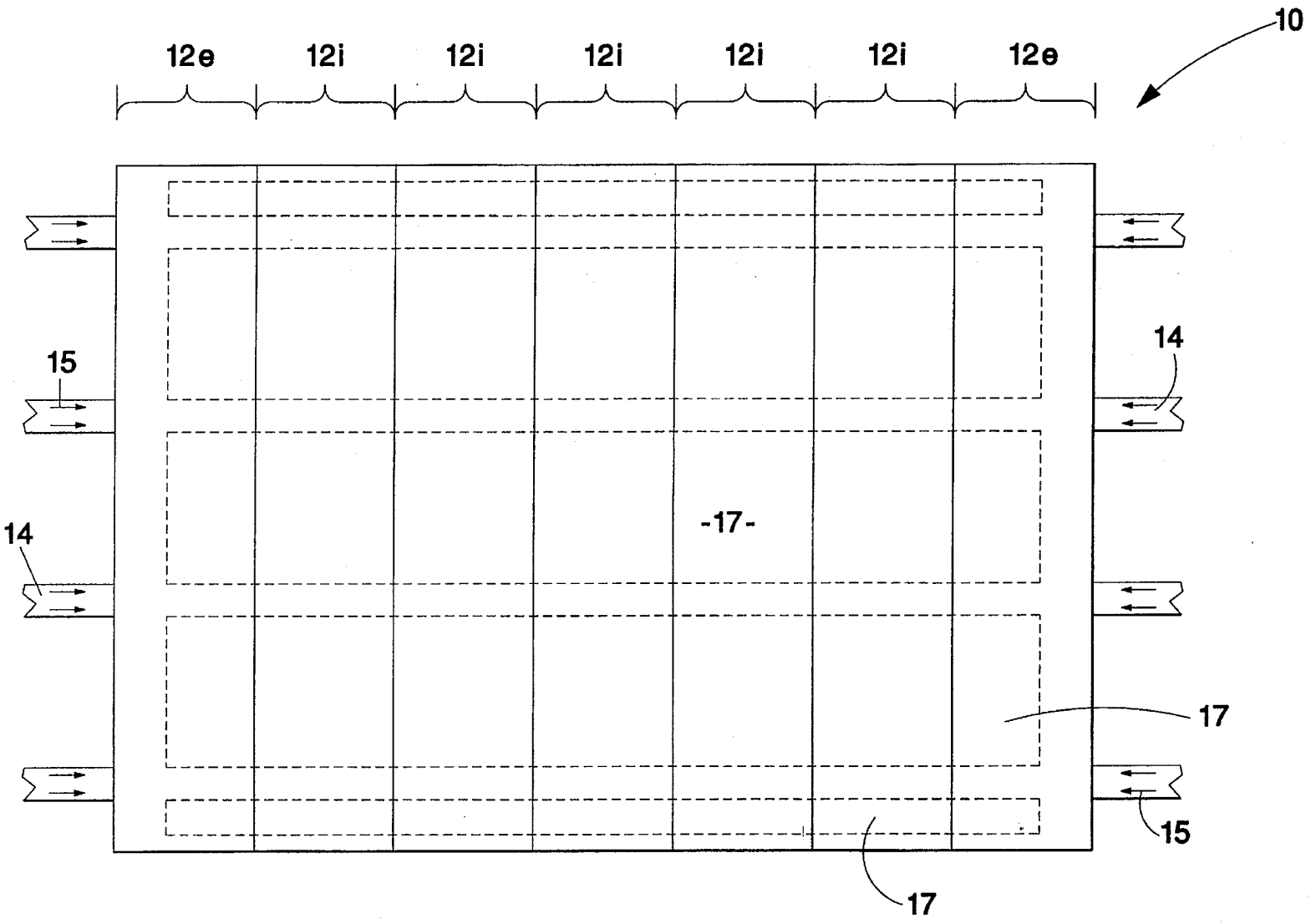
FIG. 1 is a general plan view of the post-tensioned structural support-concrete bridge deck system of the present invention.

The deck of the present invention is depicted in FIG. 1 and is generally represented by reference numeral 10. The primary application of deck 10 is for, but not restricted to, bridge super-structures including beams of structural steel, concrete or wood.

Bridge deck 10 includes a plurality of longitudinally spaced panels or sections 12 which rest upon and transfer forces to structural beams 14. In the preferred embodiment, structural beams 14 extend parallel to the roadway. However, it is possible to utilize the deck of the present invention with structural beams that extend perpendicular to the roadway.

The plurality of panels or sections 12 includes an end panel or section **12*e* at one end, at least one intermediate panel or section 12*i*, and an end panel or section 12*e* at the other end. As discussed in detail hereinafter, panels or sections 12 include provisions so that bridge deck 10 may be post-tensioned by post-tensioning devices in the direction of arrows 15 to provide additional strength to deck 10**.

As will be evident from the description hereinafter, the post-tensioning of deck 10 yields many benefits. One such benefit is the ability to reduce the amount of concrete used in deck 10, since areas 17 on the lower portion of deck 10 are not filled with concrete. The invention allows deck 10 to maintain adequate strength while reducing material costs and weight. This necessarily reduces the dead load forces transferred to structural beams 14.

Figure 2:
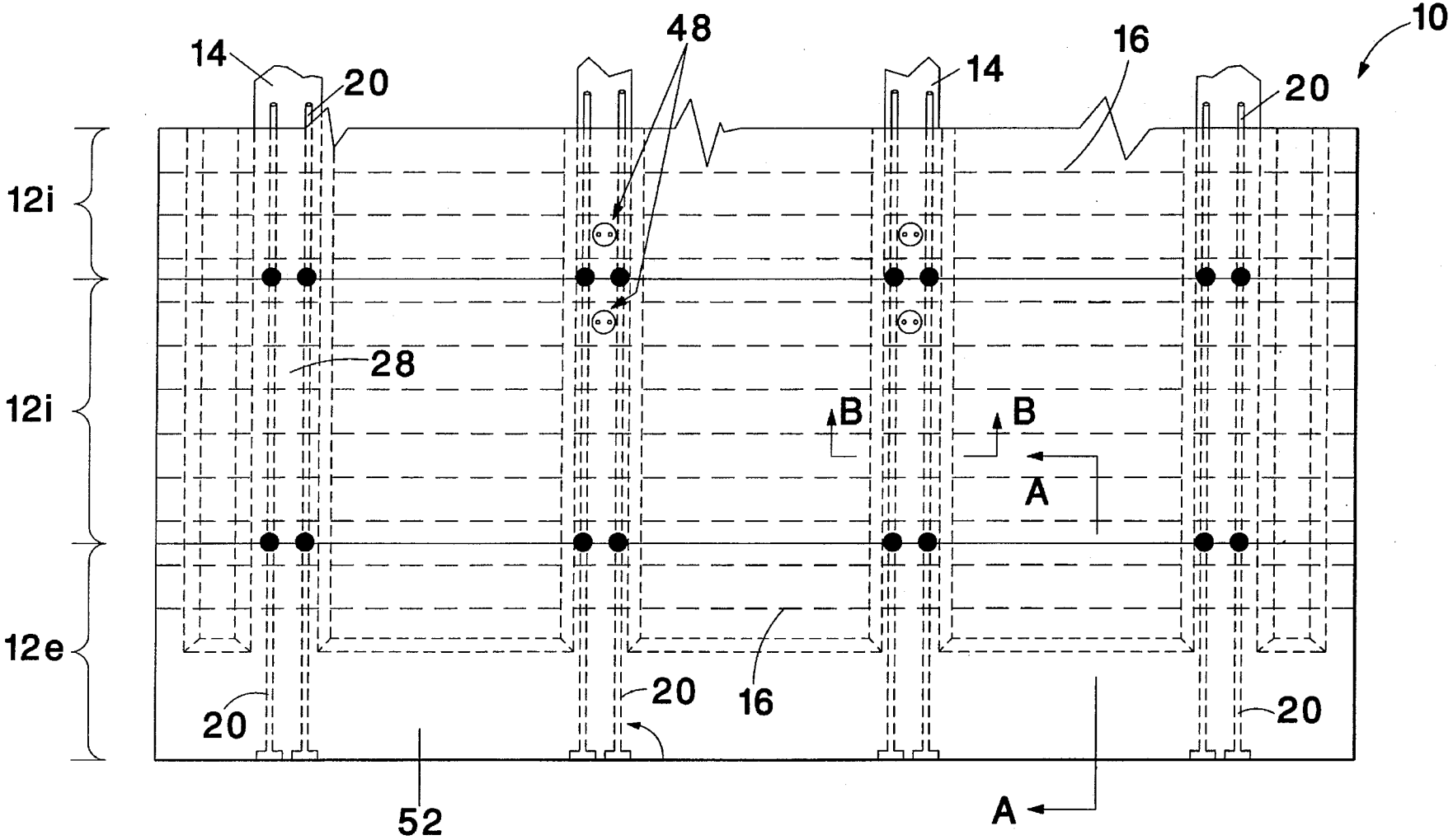
FIG. 2 is a detailed plan view of the post-tensioned structural support-concrete bridge deck system of FIG. 1.
Figure 3:
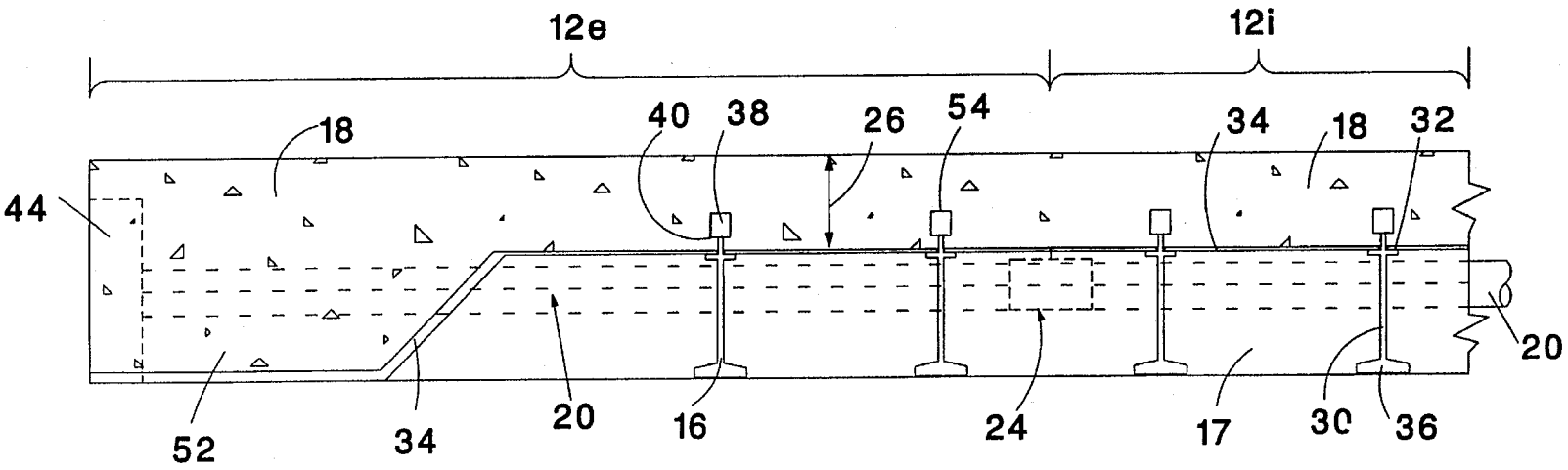
FIG. 3 is a vertical section taken through A—A of FIG. 2.
Figure 4:
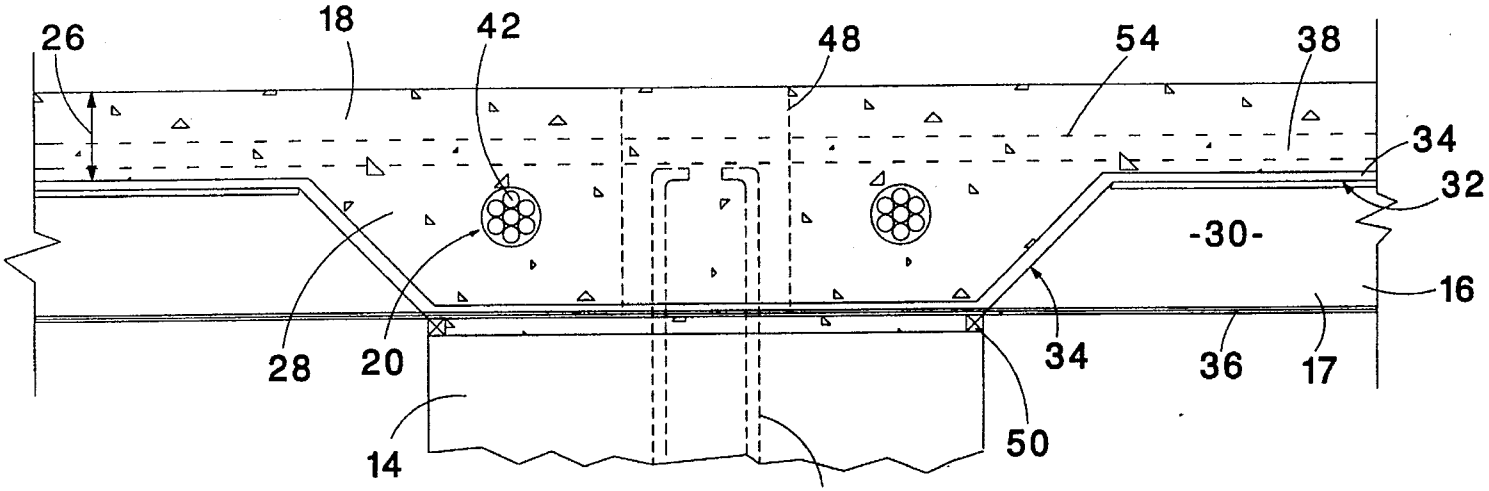
FIG. 4 is a vertical section taken through B—B of FIG. 2.

As best depicted in FIGS. 2–4, each panel or section 12 includes a concrete component 18 and a skeletal frame. Skeletal frame includes a plurality of spaced steel structural support bars 16, schematically shown in FIG. 2 by their center lines, oriented substantially perpendicular to structural beams 14 and post-tensioning ducts 20 which extend through and are oriented perpendicular to structural support bars 16.

Figure 5B:
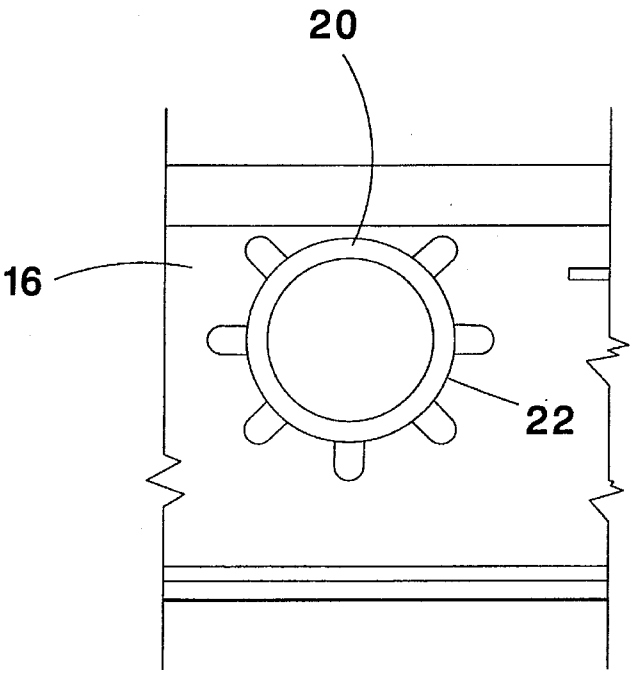
FIG. 5B is a vertical section of an alternate embodiment of a post-tensioning duct and structural supporting bar connection.
Figure 5A:
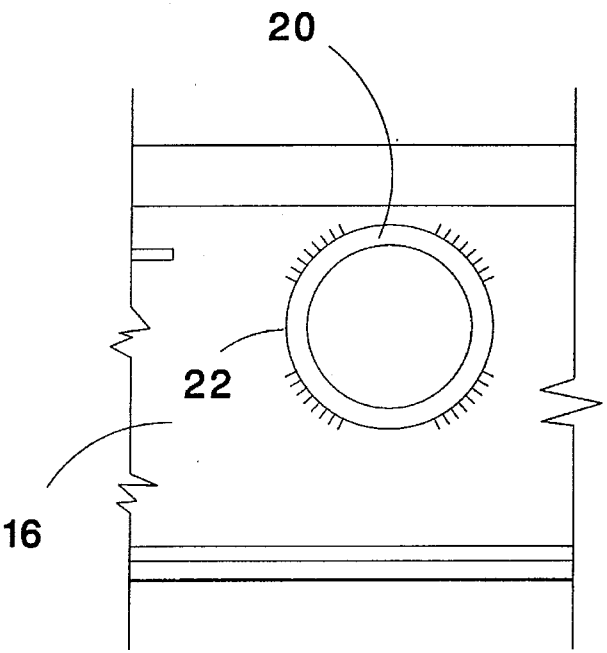
FIG. 5A is a vertical section of a post-tensioning duct and structural supporting bar connection.

To form skeletal frame, structural support bars 16 include holes 22 therein permitting the insertion of post-tensioning ducts 20 perpendicular thereto. Post-tensioning ducts 20 may be made of plastic or metal and are attached to structural support bars 16 by a suitable method. For example, if ducts 20 are metal, they may be welded to structural support bars 16, as shown in FIG. 5A. Another suitable method for attaching ducts 20 to bars 16 is to configure holes 22 to be web slotted and crimped, as shown in FIG. 5B, so that a mechanical fit is achieved when duct 20 is inserted therein. These attachment methods are merely illustrative and those skilled in the art will recognize other methods and devices for attaching ducts 20 to structural support bars 16.

Post-tensioning ducts 20 of adjacent sections 12 are coupled together to form continuous coaxial ducts which extend between both end sections 12*e*. Ducts 20 are coupled by a suitable coupling device, schematically indicated in FIG. 3 by reference numeral 24. Coupling device 24 can take the form of duct tape and/or a pipe section which has an interior diameter slightly larger than the exterior diameter of ducts 20. However, other appropriate methods or devices could also be used. It is preferable that any coupling device 24 create a waterproof seal which prevents water or concrete from entering the interior of duct 20.

Concrete component 18 is shaped in a manner which results in deck 10 having a significant weight reduction over other bridge decks. Instead of a continuous thick or high profile slab, concrete component 18 includes a smaller profile or thickness 26 throughout a significant portion of the deck 10 and includes haunches or downwardly depending protrusions 28 in other areas of deck 10. The elimination of concrete in the areas 17 between downwardly extending protrusions 28 amounts to a significant weight reduction and a significant reduction of dead load forces. For example, many existing bridge decks weigh up to, or in excess of, 100-pounds per square foot while bridge deck 10 of the present invention weighs approximately 56-pounds per square foot.

To support concrete component 18 during the manufacturing process, structural support bars 16 include an intermediate section 30 having outwardly extending lips 32. Lips 32 provide a supporting surface for pans 34 which are inserted between adjacent structural support bars 16 for providing a lower supporting surface for concrete component 18 until it cures. While, pans 34 are shaped to form the lower contour of concrete component 18, including downwardly depending protrusions 28, one in the art would recognize that other supporting elements and techniques could be used to support concrete component 18 until it cures.

Structural support bar 16 also includes a lower horizontal section 36 and an upper section 38. Upper section 38 extends laterally outward from intermediate section 30 and includes lower horizontal surfaces 40. When concrete component 18 is poured, concrete extends under lower horizontal surfaces 40, and upon curing, forms a mechanical lock to prevent vertical separation between concrete component 18 and structural support bar 16.

To post-tension deck 10, tendons 42 which may be high strength steel wires, strands, rods, or other highly stressable elements, are positioned within post-tensioning ducts 20. Tendons 42 are tightened, as described hereinafter, so that an already hardened concrete component 18 is pre-compressed. The ends of tendons 42 are anchored to post-tensioning anchorage elements 44. During the post-tensioning, deck 10 also shortens with respect to structural beams 14 because of the stressing of tendons 42. The post-tensioning prevents transverse, i.e., transverse to beams 14, cracking of concrete component 18. The post-tensioning also eliminates the necessity for shear connectors between bars 16 and concrete component 18.

Deck 10 is also mechanically connected to structural beams 14 to transfer shear forces thereto. Connectors 46 are affixed to beams 14 and vertical slots or holes 48 in concrete component 18 should accommodate connectors 46. During a secondary operation, after deck 10 has been post-tensioned, holes 48 are filled by concrete to provide a mechanical lock between beam 14 and concrete component 18, via connectors 46. The type, number, and placement of connectors 46 can vary according to the size of bridge deck 10, spacing and material of beams 14, and numerous other factors. If desired, seals 50 may be placed between beam 14 and concrete component 18 to prevent the egress of concrete during this secondary operation.

To maximize the performance of deck 10, the prestressing force should be evenly distributed as much as possible along the width of the deck. This requires an end-zone area 52 of solid concrete with appropriate length and reinforcement. Deck 10 is most economical when the number of end zone areas 52 is kept to two. For multi-span structures, this results in a preference for continuous structures and uninterrupted decks.

Deck 10 has the capability of being assembled with precast panels 12 or manufactured with sections 12 cast-in-place. If it is desired to manufacture deck 10 from precast panels, two end panels 12*e* and the required number of intermediate panels 12*i* are typically formed off-site.

Panels 12 are formed by first assembling a skeletal unit. Structural support bars 16 are cut to a length preferably equal to the width of the bridge. Bars 16 are bored or stamped creating holes 22 to receive the post-tensioning ducts 20 and are bent to accommodate the vertical alignment of the deck, if necessary. Ducts 20 cut into lengths equal to the width of panel 12 are then mechanically attached to structural support bars 16 in a manner previously described. The duct-structural support bar connection should be reasonably rigid to hold until the concrete is poured and subsequently cures. Once the concrete has cured, the connection has no further structural purpose. Pans 34 are positioned on lips 32 of bars 16 and concrete is poured thereon.

Precast panels 12 are then transported to the site and are arranged on structural beams 14 with ducts 20 of adjacent panels in horizontal alignment and with shear connectors 46 and vertical holes 48 in vertical alignment. Ducts 20 are then coupled. Post-tensioning tendons 42 are inserted through the continuous ducts 20. Concrete or grout is poured in a keyway, not shown, located between adjacent panels 12 and is permitted to substantially cure. Upon substantial curing of the concrete, tendons 42 are tightened and anchored to end panels 12*e* via post-tensioning anchorage elements 44. Then holes 48 are filled with concrete or grout.

If it is desired to form bridge deck 10 using panels with a cast-in-place construction, a number of skeletal units are formed off-site, as described above. If the length of structural support bars 16 either exceeds 60.0-feet or is curtailed by transportation regulations, field splicing of the bars should be considered. The duct-structural support bar connection should be reasonably rigid and should hold during transportation and construction, however, as previously described, once the concrete has cured, the connection has no further structural purpose. The estimated weight of a 60.0-feet×8.5-feet steel skeletal unit is 3,400-pounds, thus easily transportable by trucks.

The skeletal units are positioned on the beams with the help of inorganic shims, then the duct-ends are coupled by either duct-taping or other appropriate method. Pans 34 are placed on lips 32 to support concrete to be poured and to form downwardly projecting protrusions 28. Next the concrete is poured and vertical edges of concrete component 18 are formed at the sides, in end-zone areas 52, and over beams 14.

The concrete strength should preferably be at least 4,500-pounds per square inch at 28 days, although the hard-pack overlay is known to produce easily 6,000-pounds per square inch in three days. The concrete should preferably be wet-cured for 72-hours and protected by plastic cover for another 120 hours to reduce shrinkage. During the curing period the post-tensioning tendons 42 can be pulled in and prepared for stressing. During and because of the post-tensioning, the deck shortens and moves with respect to the beams. If time permits the tendons may be restressed to reduce effective shrinkage and creep.

The top edges of the beams are sealed by seals 50, as shown in FIG. 4. Prior to pouring the secondary concrete, the vertical edges of the primary concrete at holes 48 should be preferably smeared with a sand-cement slurry of appropriate mix. The secondary concrete should be cured in a manner similar to the primary concrete. Grinding of the concrete surface in the vicinity of the interface between the primary and secondary concretes may be required.

Due to strength of deck 10 achieved by post-tensioning, concrete component 18 does not require reinforcing bars. Specifically, concrete component 18 is void of reinforcing bars above a horizontal plane defined by the top surfaces 54 of structural support bars 16, which is where many existing decks position reinforcing bars.

While particular embodiments of the invention have been shown and described, it is recognized that various modifications thereof will occur to those skilled in the art. Therefore, the scope of the herein-described invention shall be limited solely by the claims appended hereto.

I claim:

1. A structural bridge deck comprising:

a plurality of concrete components including a first end concrete component and a second end concrete component, each said concrete component having downwardly projecting protrusions;

a plurality of structural support bars embedded in each said concrete component, said structural support bars being substantially perpendicular to said downwardly projecting protrusions, said structural support bars include web portion and horizontal holes located in the web portions;

a plurality of post-tensioning ducts, each post-tensioning duct being oriented perpendicular to said structural support bars, each said post-tensioning duct extending substantially continuously through said plurality of concrete components and through said holes in said structural support bars, wherein each said post-tensioning duct includes hollow duct members cast into said downwardly projecting protrusions of said concrete components, said post-tensioning ducts extend parallel to, and through, said downwardly projecting protrusions; and flexible post-tensioning tendons located in said post-tensioning ducts, said post-tensioning fending each including a first end anchored to an end of the first end concrete component and a second end anchored to an end of the second end concrete component, said tendons being placed in tension.

2. The structural deck of claim 1, wherein each of said concrete components is void of reinforcing bars above a top surface of said structural support bars.

3. The structural deck of claim 1, further comprising a plurality of spaced beams oriented substantially perpendicular to said support bars, wherein the beams include vertically oriented shear connectors attached thereto and said concrete component further having vertically oriented holes to accommodate said vertically oriented shear connectors.

4. The structural deck of claim 1, wherein said post-tensioning ducts are affixed directly to said structural support bars.

5. The structural deck of claim 4, wherein the duct members of the post-tensioning ducts are affixed to said structural support bars by a weld.

6. The structural deck of claim 4, wherein said holes in said structural support bars are slotted and crimped to affix the duct members of the post-tensioning ducts to the structural support bars.

7. The structural deck of claim 1, wherein said structural support bars include outwardly extending flanges, the structural deck further comprising pans extending between and supported by flanges of adjacent structural support bars for providing a support surface for said plurality of concrete components, wherein areas between adjacent structural support bars, between adjacent downwardly projecting protrusions and below said pans being void of concrete.

8. The structural deck of claim 1, wherein the duct members of the post-tensioning ducts are made of plastic.

9. The structural deck of claim 1, wherein the duct members of the post-tensioning ducts are made of metal.

* * * * *

UNITED STATES PATENT AND TRADEMARK OFFICE

CERTIFICATE OF CORRECTION

PATENT NO. : 5,457,839

DATED : October 17, 1995

INVENTOR(S) : Paul F. Csagoly

It is certified that error appears in the above-identified patent and that said Letters Patent is hereby corrected as shown below:

Column 6, line 18,
"fending" should be replaced by --tendons--.

Signed and Sealed this

Twelfth Day of December, 1995

*Attest:*

*Attesting Officer*

BRUCE LEHMAN

*Commissioner of Patents and Trademarks*